US006694900B2

(12) United States Patent
Lissianski et al.

(10) Patent No.: US 6,694,900 B2
(45) Date of Patent: Feb. 24, 2004

(54) INTEGRATION OF DIRECT COMBUSTION WITH GASIFICATION FOR REDUCTION OF NOX EMISSIONS

(75) Inventors: Vitali Lissianski, San Juan Capo, CA (US); George Rizeq, Mission Viejo, CA (US); Vladimir Zamansky, Oceanside, CA (US)

(73) Assignee: General Electric Company, Schenectady, NY (US)

( * ) Notice: Subject to any disclaimer, the term of this patent is extended or adjusted under 35 U.S.C. 154(b) by 99 days.

(21) Appl. No.: 10/014,828

(22) Filed: Dec. 14, 2001

(65) Prior Publication Data

US 2003/0110994 A1 Jun. 19, 2003

(51) Int. Cl.[7] ..... F23J 15/00; F23B 7/00

(52) U.S. Cl. ..... 110/345; 110/229; 110/342; 110/344; 110/233

(58) Field of Search ..... 110/218, 219, 110/229, 230, 231, 233, 234, 341, 342, 344, 345

(56) References Cited

U.S. PATENT DOCUMENTS 4,235,174 A * 11/1980 Spurrell ..... 110/346
4,616,576 A * 10/1986 Engstrom et al. ..... 110/345
5,270,025 A 12/1993 Ho et al.
5,320,052 A * 6/1994 Spokoyny et al. ..... 110/345
5,425,317 A * 6/1995 Schaub et al. ..... 110/346
5,471,957 A * 12/1995 Brady et al. ..... 122/367.1
5,582,137 A * 12/1996 Brady et al. ..... 122/367.1
5,626,088 A * 5/1997 Hiltunen et al. ..... 110/243
5,756,059 A 5/1998 Zamansky et al.
5,826,521 A * 10/1998 Schumann et al. ..... 110/345
6,085,674 A * 7/2000 Ashworth ..... 110/347
6,325,002 B1 * 12/2001 Ashworth ..... 110/345
6,357,367 B1 * 3/2002 Breen et al. ..... 110/345

OTHER PUBLICATIONS

Bales, F.E., Inkley, D.S., Lighty, J.S., Pershing, D.W., Brouwer, J., and Heap, M. 25$^{th}$ Symposium (International) on Combustion, Poster 32, Irvine, CA 1995, 1 page.

Harding, N.S., and Adams, B.R. *Biomass and Bioenergy* 19:429–445 (2000), Biomass as a reburning: a specialized cofiring application.

(List continued on next page.)

*Primary Examiner*—K. B. Rinehart
(74) *Attorney, Agent, or Firm*—Hunton & Williams LLP

(57) ABSTRACT

The methods and systems of the present invention reduce NOx emissions in combustion systems, e.g., power plants, boilers, furnaces, incinerators, engines, and any combinations thereof. The inventive process decreases NOx emissions from stationary combustion sources and provides improved utilization of low-grade biomass and other waste fuels without slagging and fouling problems. The invention reduces NOx emissions while utilizing gasified fuels, including biomass and low-grade waste fuels, by gasifying solid fuels and injecting produced gas into a reburning zone of, for example, a boiler at relatively low temperatures and in relatively small amounts. By feeding the gas directly into a reburning zone, the need for gas cleaning is eliminated or substantially reduced as tars are burned in the flame and alkali species may be present at much lower levels than is the case with direct combustion applications.

45 Claims, 11 Drawing Sheets

OTHER PUBLICATIONS

Rudiger, H., Greul, U., Spliethoff, H. and Hein, K.R.G., *3d International Conf. on Combustion Technologies for a Clean Environment,* Lisbon, Portugal, Jul. 3–6, 1995, pp. 9–16.

Hughes, E. *Biomass and Bioenergy* 19:457–465 (2000), Biomass cofiring: economics, policy and opportunities.

Tillman, D.A. *Biomass and Bioenergy* 19:365–384 (2000), Biomass cofiring: the technology, the experience, the combustion consequences.

Zamansky, V.M., Jenkins, B.M., Miles, T.R., and Tiangco, V.M. 4$^{th}$ Biomass Conference of the Americas (R.P. Overend and E. Chornet, edds.), Pergamon, p. 1335–1340, 1999, Hybrid Combustion–Gasification Concept For Environmentally Safe Utilization Of Biomass Energy.

Alakangas, E. *Bioenergy in Finland, Final Report of Finland—Phase II,* ENE39/T0024/97, VTT Energy, 1997, 62 pages.

Kau, C.J., Heap, M. P., Seeker, W. R. and Tyson, T. J., Fundamental Combustion Research Applied To Pollution Formation, vol. IV, 5–1– 5–8.

Feitelberg, A. Keq, CET93 For Windows 95 Windows NT 4.0, a Chemical Equilbrium and Transport Properties Calculator, pp. 1–9.

A. Brink, S. Boström, P. Kilpinen and M. Hupa, IFRF Combustion Journal, Article 200107, Sep. 2001, Modeling Nitrogen Chemistry in the Freeboard Of Biomass–FBC, pp. 1–14.

R. Perry, and J. Miller, International Journal of Chemical Kinetics, vol. 28, 217–234, An Exploratory Investigation of the Use of Alkali Metals in Nitrous Oxide Control.

V. Lissianski, V. Zamansky, P. Maly, and M. Sheldon, Presented at the 28$^{th}$ Symposium 9International) on Combustion, University of Edinburgh, Scotland, Jul. 30–Aug. 4, 2000, Optimization of Advanced Reburning Via Modeling, pp. 1–9.

GRI–Mech Home Page, 6 pages, printed Nov. 27, 2001, <http://www.me.berkely.edu/gri_mech/.

Chen, S.L., Kramlich, J.C., Seeker, W.R., and Pershing, D.W. *JAPCA* vol. 39, No. 10, p. 1375–1379 (1989), Optimization of Reburning for Advanced Nox Control on Coal–fired Boilers.

Koppang, R., Moyeda, D., and Donaldson, L. *56$^{th}$ Conference on Glass Problems,* Urbana, IL, p. 19–35 (1995).

Glarborg, P., Kristensen, P.G., Dam–Johansen, K., Alzueta, M.U., Millera, A., and Bilbao, R. *Energy & Fuels* 14:828–838 (2000), Nitric Oxide Reduction by Non–hydrocarbon Fuels. Implications for Reburning with Gasification Gases.

Chen, S.L., McCarthy, J.M., Clarck, W.D., Heap., M.P., Seeker, W.R., and Pershing, D.W. *Proc. Combust. Inst.* 21:1159–1169 (1986), Bench and Pilot Scale Process Evaluation of Reburning for In–Furnace NO x Reduction.

Glickert, R.W., Herzau, J.S., Meskimen, R.L., and Pratapas, J.M. EPRI–DOE–EPA Combined Utility Air Pollutant Control Symposium *The Mega Symposium,* Washington, DC 1997, Application Of Fuel Lean Gas Reburn Technology at Commonwealth Edison's Joliet Generating Station 9, 14 pages.

Zamansky, V.M., Ho, L., Maly, P.M., and Seeker, W.R., *Proc. Combust. Inst.* 26:2075–2082 (1997), Reburning Promoted By Nitrogen– And Sodium–Containing Compounds.

Zamansky, V.M., Sheldon, M.S., and Maly, P.M., *Proc. Combust. Inst.* 27:3001–3008 (1998), Enhanced NO x Reduction By Interaction Of Nitrogen And Sodium Compounds The Reburning Zone.

Zamansky, V.M., Maly, P.M., Lissianski, V.V., and Freeman, M.C. *8$^{th}$ Biennial Conference BIOENERGY'98,* Madison, Wisconsin, 1998, Development Of Biomass Reburning Technologies, 10 pages.

Zamansky, V.M., Maly, P.M., Seeker, W.R., and Folsom, B.A. 10$^{th}$ European Conference and Technology Exibition *Biomass for Energy and Industry,* Würzburg, Germany, 1998, pp. 1537–1540, Biomass Fuels In Reburning Technologies.

* cited by examiner

INTEGRATION OF DIRECT COMBUSTION WITH GASIFICATION FOR REDUCTION OF NOX EMISSIONS

BACKGROUND OF THE INVENTION

One of the major problems facing today's society and future generations is the production of air pollution by a variety of combustion systems, such as boilers, furnaces, engines, incinerators and other combustion sources. Air pollutants produced by combustion include particulate emissions, such as fine particles of fly ash from pulverized coal firing, and gas-phase (non-particulate) species, such as oxides of sulfur ($SO_x$, principally $SO_2$ and $SO_3$), carbon monoxide, volatile hydrocarbons, volatile metals (i.e., mercury—Hg), and oxides of nitrogen (mainly NO and $NO_2$). Both NO and $NO_2$ are commonly referred to as "$NO_x$" because they interconvert, the NO initially formed at higher temperature being readily converted to $NO_2$ at lower temperatures. The nitrogen oxides are the subject of growing concern because of their toxicity and their role as precursors in acid rain and photochemical smog processes.

One other major problem facing society is the ever expanding consumption of and dependence on energy, including specifically fossil fuels. One area of great promise for better, more efficient and environmentally conscious energy usage is in the utilization of waste fuels for energy production. Large quantities of agricultural and other biomass resources are available throughout the world. Biomass is a renewable source of energy, but a lot of this material is being land filled, burned in the open fields, or plowed under and, thus, are not utilized as an energy feedstock. Utilization of biomass for energy production eliminates costs for its disposal, provides a renewable energy resource and decreases CO2 emissions. Currently, due to slagging and fouling of boilers' heat transfer surfaces, biomass boilers cannot use a variety of bio-feedstocks with high alkali content.

Accordingly, two key needs are 1) decreasing NOx emissions from combustion sources and 2) increasing utilization of low-grade waste fuels for energy production.

There are several commercial technologies that are available to control NOx emissions from stationary combustion sources. Combustion modifications such as Low NOx Burners (LNB) and overfire air (OFA) injection provide only modest NOx control, on the level of 30–50%. However, their capital costs are low and, since no reagents are required, their operating costs are near zero. For deeper NOx control, Selective Catalytic Reduction (SCR), reburning, Advanced Reburning (AR) or Selective Non-Catalytic Reduction (SNCR) can be added to LNB and OFA, or they can be installed as stand alone systems.

Currently, SCR is the commercial technology with the highest NOx control efficiency. With SCR, NOx is reduced by reactions with N-agents (ammonia, urea, etc.) on the surface of a catalyst. The SCR systems are typically positioned at a temperature of about 700° F. SCR can relatively easily achieve 80% NOx reduction. However, SCR is far from an ideal solution for NOx control. There are several important considerations, including cost. SCR requires a catalyst in the exhaust stream. Catalysts and related installation and system modifications are expensive. In general, SCR catalyst life is limited. Catalyst deactivation, due to a number of mechanisms, typically limits catalyst life to about four years for coal-fired applications. In addition, catalysts are toxic and pose disposal problems.

Reburning is a method for controlling nitrogen oxides that involves combustion of a fuel in two stages. FIG. 1 may be referred to in this discussion concerning reburning techniques. As shown in the reburning system 100 of FIG. 1, in the main combustion zone 102 80–90% of the fuel is burned with normal amount of air (about 10–15% excess). This corresponds to an Air/Fuel Stoichiometric Ratio (SR) about 1.10–1.15. The combustion process forms a definite amount of NOx. Then, in the second stage, the rest of the fuel (reburning fuel) is added at temperatures of about 2300–3000° F. into the secondary combustion zone 104, called the reburning zone, to generate a fuel-rich environment. Test results indicate that in a specific range of conditions (equivalence ratio in the reburning zone, temperature and residence time in the reburning zone) the NOx and N2O concentrations can typically be reduced by 50–60%. In the third stage 106 the OFA is injected at a lower temperature to complete combustion. Typically the OFA is injected at 1800° F.–2800° F. to achieve essentially complete combustion.

The flow diagram section, b, of FIG. 1 illustrates the main reactions in the reburning zone process. Adding the reburning fuel leads to its rapid oxidation by the excess oxygen to form CO and hydrogen. The reburning fuel provides a fuel-rich mixture with certain concentrations of carbon containing radicals 108, e.g., CH3, CH2, CH, C, and HCCO, which can react with NO. The carbon containing radicals (CHi) formed in the reburning zone are capable of reducing NO concentrations by converting it to various intermediate species with C—N bonds, 110. These species are reduced in reactions with different radicals into NHi species 112, e.g., NH2, NH, and N, which react with NO to form N2 114. N2O is reduced mainly via reaction with H atoms: N2O+H→N2+OH. The OFA added on the last stage of the process oxidizes existing CO, H2, HCN, and NH3.

Typically, reburning fuel is injected at flue gas temperatures of 2300–3000° F. The efficiency of NOx reduction in reburning increases with an increase in injection temperature. This is because at higher temperatures oxidation of the reburning fuel occurs faster, resulting in higher concentrations of carbon containing radicals involved in NOx reduction. Efficiency of NOx reduction also increases with an increase in the amount of the reburning fuel at reburning fuel heat inputs of up to 20–25%. Larger amounts of reburning fuel practically do not increase and sometimes even slightly decrease the efficiency of NOx reduction.

Conventional reburning typically requires 15% to 20% reburning fuel heat input to achieve 40%–60% NOx reduction. In so-called Fuel-Lean Reburning (FLR) the amount of the reburning fuel is controlled to maintain an overall fuel-lean stoichiometry in the upper furnace. Therefore, no additional OFA is required for completing burnout. FLR has shown the potential to achieve about 25–35% reduction in NOx emissions using 7–8% natural gas heat input or less.

Greater levels of NOx control can be achieved using Advanced Reburning (AR) techniques. AR is a synergistic combination of basic reburning and N-agent (ammonia or urea) injection. Initial AR studies focused on N-agent injection into the burnout zone (AR-Lean). It was found that AR-Lean incorporates the chain branching reaction of CO oxidation which promotes the reaction between NO and ammonia. When CO reacts with oxygen, it initiates many free radicals. Experiments and modeling studies have demonstrated that the de-NOx temperature window can be substantially broadened and NO removal efficiency increased, if both CO and the O2 concentrations are controlled to fairly low values (CO at the order of 1000 ppm and O2 at less than 0.5 percent). At the point of air addition, CO and O2 are both at low values because of the close approach to SR=1.0, yielding about 85% NO reduction.

Injection of small amounts of alkali promoter species, such as sodium carbonate, along with ammonia into the reburning zone (AR-Rich) can further improve upon the AR process. These AR improvements are capable of achieving greater than 90% NOx control.

Waste fuels can be very effective for reburning. Tests with several feedstocks (yard waste, furniture manufacturing sawdust, walnut shells, willow wood, waste coal fines and others) demonstrate that advanced waste reburning technologies can achieve higher NOx reduction even than that achieved with natural gas. Efficiency of NOx reduction for most waste fuels increase with an increase in the amount of the reburning fuel.

In one technique, biomass pyrolysis gas serves as the reburning fuel. Pyrolysis-based units produce gas, char and tar. Using a reburning technique, pyrolysis products are injected in a combustor as reburning fuel at different temperatures of pyrolysis and various air/fuel stoichiometric ratios in the combustor's reburning zone. Maximum NOx control performance of 87% has been achieved with biomass gas combined with the tar formed at pyrolysis temperature of 1650° F. At a stoichiometric ratio of 0.8, biomass gas has exceeded the performance of natural gas, which was about 75%.

A number of efforts have been made to utilize waste fuels for energy production. One driving force to make fuel-flexible power technologies less costly than conventional fuel power technologies is the low or negative cost associated with opportunity fuels. Another reason is the societal goals, energy conservation, environmental conservancy and care, and others. Large quantities of opportunity fuels including urban wood waste, agricultural residues, forest waste, municipal solid waste, and sewage sludge are land filled and, accordingly, their beneficial uses are unrealized. These feedstocks are low-grade waste fuels.

There are several technologies that are available to produce energy from waste fuels. Direct combustion involves the burning of fuel with excess air, producing hot flue gases that are used to produce steam in the heat exchange sections of boilers. The steam is used to produce electricity in steam turbine generators.

Direct combustion of waste fuels has proven inefficient because of poor combustion characteristics generally associated with waste fuels. When compared to fossil fuels, waste fuels have a heterogeneous composition, sometimes high ash and/or moisture content, low heating value, substantial chlorine content, and trace heavy metal content. Because of that, existing biomass boilers are limited in efficiency and suffer undesirable consequences of fuel ash fouling. Combustion of these fuels requires expensive solids handling equipment, corrosion protection, high excess air, scrubbers, filters, and other air pollution control systems.

Co-firing refers to the practice of introducing biomass or waste fuels in the main combustion zone of fossil fuel fired boilers as a supplementary energy source. Co-firing has been evaluated for a variety of boiler technologies including pulverized coal combustors, fluidized bed units, and stokers. Because waste fuel comprises only a fraction of fossil fuel, negative impact of waste fuel on boiler performance is reduced in co-firing.

As an alternative for direct waste combustion, gasification can be applied to a variety of waste products, providing a cleaner gaseous fuel. The gasification process takes solid waste products and improves its combustion characteristics, handleability, and simultaneously may reduce pollutant emissions. Gasifiers can frequently handle high fouling fuels without excessive slagging/fouling due to the lower temperatures at which they can operate in comparison with direct combustion units. Waste fuel gasification generally involves heating fuel in an oxygen-starved environment to produce a medium or low calorific gas. This "biogas" is then used as fuel in a combined cycle power generation plant that includes a gas turbine topping cycle and a steam turbine bottoming cycle, or can be used for co-firing in coal and biomass fired boilers.

SUMMARY OF THE INVENTION

The present invention is related to processes for removing emissions of nitrogen oxides in combustion systems. More specifically, the present invention provides methods for decreasing nitrogen oxides emissions from stationary combustion sources and for utilizing low-grade biomass and other waste fuels without slagging and fouling problems.

The present invention represents an improvement over prior techniques in that it presents methods and systems that effectively and efficiently reduce NOx while utilizing gasified fuels, including biomass and low-grade waste fuels. In general, the present invention unconventionally achieves these improvements by gasifying solid fuels and injecting produced gas into a reburning zone of a boiler at relatively low temperatures and in relatively small amounts. If the gas is fed into a reburning zone of a boiler, the gas cleaning requirement is eliminated or substantially reduced, as tars are burned in the flame and alkali species may be present at much lower levels than is the case with direct combustion applications.

Importantly, there are key differences between the present invention and prior techniques, including, for instance: 1) conditions in a gasifier are such that gasification products with optimum concentrations of nitrogen (N)- and alkali (Na and K)-containing species are produced; 2) specific flue gas temperature of the boiler at which the gaseous products are injected is selected, and 3) reaction time in the post-combustion or reburning zone for effective interaction of the N- and alkali-containing species in the gasification products with NOx in flue gas is provided.

In addition, the present invention improves over prior techniques by realizing a very high efficiency of NOx removal by gasification products. Generally, propane and natural gas have been thought to be the most effective reburning fuels with coal being slightly less effective. Also, the efficiency of syngas, with CO and H2 being its major components, is much less than that of propane and natural gas. Implementation of the present invention yields the surprising result that efficiency of syngas, such as from waste gasification, under optimized conditions can be higher than that of propane and natural gas, as shown in the examples set forth in the detailed description hereinbelow. Moreover, the invention achieves efficiencies of 70% NOx reduction and higher at 6%–8% reburning fuel heat inputs. This result is quite remarkable and unexpected since in Fuel-Lean Reburning only 25–35% reduction in NOx emissions is obtained using 7–8% natural gas heat input.

Particular embodiments of the invention provides a method of decreasing emissions of nitrogen oxides (NOx) in combustion systems in combination with utilization of at least one low grade solid fuel. The inventive method comprising the steps of: causing the combustion of a main fuel in a combustion system, thereby resulting in the generation of a combustion flue gas in a post combustion zone, the combustion flue gas comprising nitrogen oxides; gasifying at least one solid fuel in a gasifier causing the generation of a gaseous product containing solid particles, the gaseous product comprising one or more of the group consisting of carbon monoxide, hydrogen, hydrocarbons, water, carbon dioxide, ammonia and other reduced N-containing species, and small amounts of alkali-containing compounds; and injecting the gaseous product into the post combustion zone of the combustion system to create a reaction zone in which nitrogen oxides are reduced to molecular nitrogen by introducing the gaseous product into the post combustion zone at a temperature designed to promote reaction of NO with one or more of the group comprising syngas components, CO, H2, hydrocarbons, ammonia, and N- and alkali-containing compounds.

In another embodiment, the invention provides a combustion system for causing the combustion of fuel, the combustion of fuel resulting in the generation of post-combustion flue gas, including NOx, the combustion system comprising: a primary combustion zone in which the combustion of a main fuel occurs, the combustion of the main fuel generating flue gas, which exit the combustion zone; a post-combustion zone for receiving the flue gas; and a gasifier receiving biomass or waste fuel and producing a gaseous product at least in part therefrom and delivering the gaseous product into the post-combustion zone for reacting with the flue gas to reduce NOx emissions, the gaseous product being introduced into the post combustion zone at a temperature designed to promote reaction of NO with one or more of the group comprising syngas components, CO, H2, hydrocarbons, ammonia, and N- and alkali-containing compounds.

It is therefore an object of the present invention to provide methods for eliminating or at least dramatically reducing nitrogen oxides from combustion flue gas before they are emitted to the atmosphere.

It is an object of the invention to introduce gaseous products into a post combustion zone at such a temperature so as to promote the reaction of ammonia and alkali-containing compounds with NO contained in flue gas to reduce NOx emissions.

It is another object of the present invention to decrease the concentration of nitrogen oxides formed in combustion by injection gasification products of different fuels into a post combustion or reburning zone of a combustion system.

It is another object of the present invention to utilize biomass and low-grade waste fuels with high fuel-N and alkali content for production of syngas.

Additional objects and advantages of the present invention will be apparent to those skilled in the art upon reading the description and claims and examining the figures, or may be learned by the practice of the invention.

DETAILED DESCRIPTION OF THE INVENTION

The present invention discloses a method for decreasing concentration of NOx in flue gas of combustion systems. According to the present invention, the NOx concentration can be reduced by combining direct gasification of solid fuels, including biomass and low-grade waste fuels, with reburning under specific conditions.

As will be appreciated by consideration of the following description as well as the accompanying figures, the present invention may be embodied in different forms. The embodiments described herein represent a demonstration of modes for carrying out the invention. Nevertheless, many embodiments, or variations of them, other than those specifically detailed herein, may be used to carry out the inventive concepts described in the claims appended hereto. The invention can be applied to various combustion facilities, e.g., power plants, boilers, furnaces, incinerators, engines, and any combinations thereof, and utilizes solid fuels including coal, biomass and waste fuels.

Figure 2:
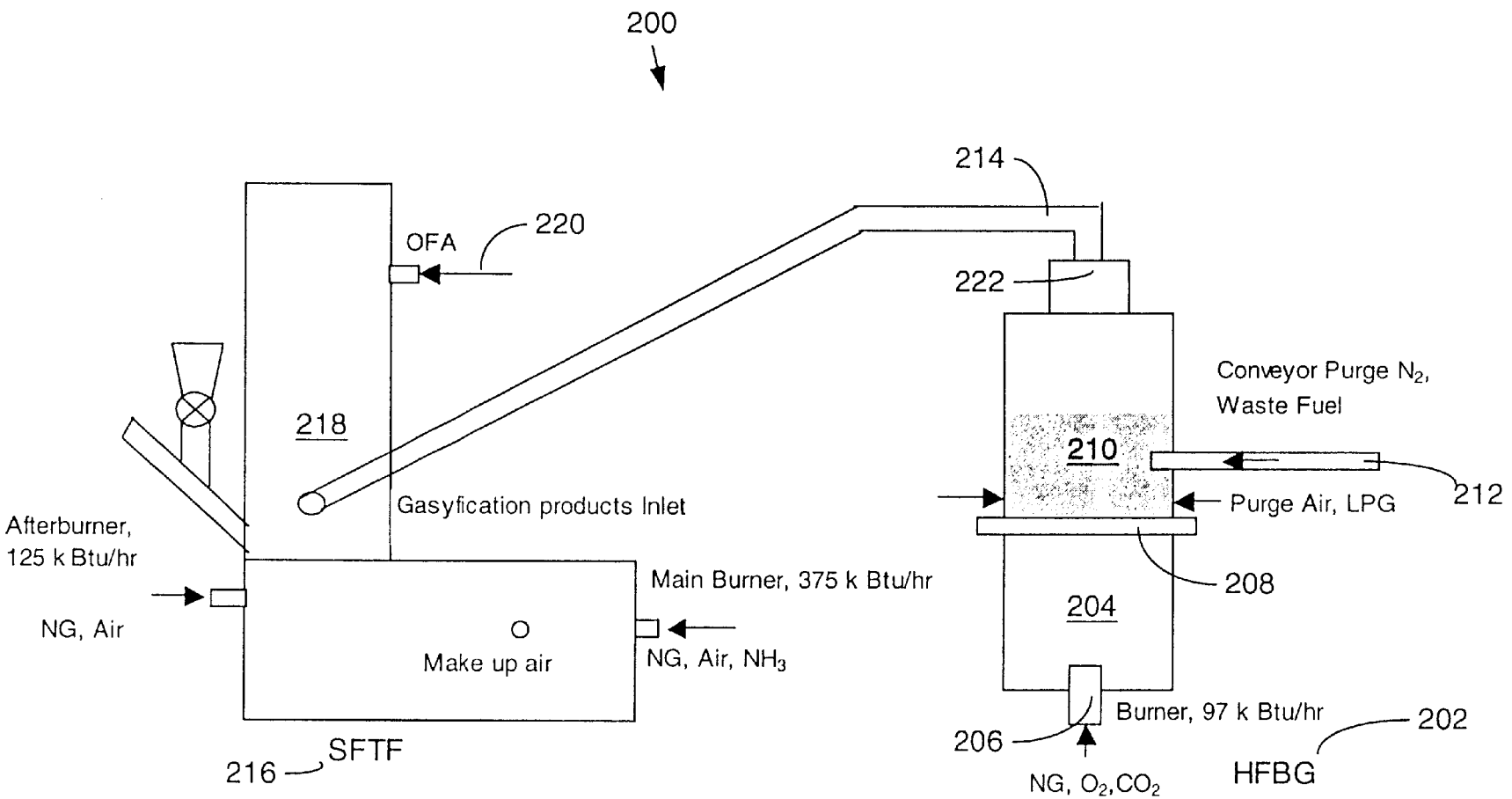
FIG. 2 is a schematic diagram illustrating a reburning and gasification arrangement incorporating the present invention.

FIG. 2 demonstrates an exemplary embodiment 200 for integrating waste fuel gasification with reburning in a pilot-scale combustor, such as for testing the efficacy of this approach. In this example, waste fuel gasification was conducted in a Hybrid Fluidized Bed Gasifier (HFBG) 202. The HFBG includes an auxiliary combustor 204 fired by natural gas burner 206. The fluidized bed 210 is separated from the burner by a distributor plate 208. The waste fuel 212 is fed directly into to the bed from a side port. The syngas is transported via a metal duct 214 to the Solid Fuels Test Facility (SFTF) 216 that simulates, and in practice may be replaced with, for example, a stoker-boiler. The primary fuel for the SFTF is, in one example, natural gas, but may be other fuels such as other fossil fuels or biomass/waste fuels. The syngas is injected into the SFTF reburning zone 218. Overfire air 220 is injected upstream of the reburning fuel injection to complete combustion.

As shown by experimental and modeling results presented in the next section, conditions in the gasifier 202 can be optimized to produce syngas 222 with certain concentrations of N- and alkali-containing species. Fuel-N from waste fuel is released in the gasifier mostly in the form of NH3. Sodium and potassium from waste fuel are released into the gas phase or carried to the reburning zone of the combustor with fly ash. Injection of syngas into the SFTF reburning zone under certain process conditions will result in a significant decrease in NOx concentration in flue gas. When conditions in the reburning zone of a boiler are optimized, the presence of NH3 and sodium in biogas will result in an increase in NOx reduction in comparison with traditional (basic) reburning.

Additional NOx reduction under optimized conditions of the present invention will occur at relatively low reburning fuel injection temperatures as required for effective reactions between NOx and syngas components, such as CO, H2, hydrocarbons, ammonia, and N- and alkali-containing compounds. Prior teachings stand for the proposition that reburning efficiency increases with an increase in the amount of the reburning fuel and in the temperature of flue gas at the injection point of the reburning fuel. One unexpected finding associated with the present invention is that the efficiency of NOx reduction increases with a decrease in the post combustion or reburning fuel injection temperature. In one example, the efficiency was optimized with the flue gas temperature in the range of 1200–2200° F. at the location of the reburning fuel injection. Another surprising finding associated with the present invention is that maximum NOx reduction may be achieved at 5%–15% reburning heat input rather than at 20%–25% as suggested in prior teachings.

In one set of conditions used to exemplify the operational efficacy of the embodiment of FIG. 2, the reburning fuel, i.e. the gaseous product from HFBG 202, is injected in the range of flue gas temperatures of 1800° F.–2200° F. This is quite distinct when compared with prior teachings, wherein typical reburning applications call for OFA to be injected in the temperature range of 2300° F.–3000° F. A variety of test conditions in the embodiment of FIG. 2 yield that CO concentrations in flue gas at the SFTF exit fall below 10 ppm. It is possible to achieve such low CO concentrations in combustion products at OFA injection temperatures of 1700–1900° F. because reburning fuel was a gas.

Significant NOx reduction for fuels with high fuel-N content may be achieved at 5–15% reburning fuel heat input with maximum NOx reduction at 7–10% reburning fuel heat input. At this amount of reburning fuel, the overall mixture composition remains fuel-lean. Thus, after complete oxidation of the reburning fuel, some amount of O2 is still present in flue gas. Injection of OFA at such small amount of the reburning fuel is optional since complete oxidation of the reburning fuel can be achieved by oxygen already present in flue gas. Additional control of CO and hydrocarbon emissions, if required, can be provided by installing an afterburner or an oxidation catalytic unit in the post-combustion zone downstream of reburning fuel injection.

As an option, the gaseous and solid gasification products can be separated before injection into the combustion system. Some solid fuels (for example, coal and some types of waste fuels) consist of approximately equal fractions of volatile matter and fixed carbon. Complete gasification of such fuels requires high temperatures, long residence times and is difficult to achieve. Splitting the fuel stream exiting the gasifier allows the volatile matter to be used for reburning and the fixed carbon to be injected into the high-temperature main combustion zone. Thus, fuels with low volatile content can also be used in the present invention.

Figure 1:
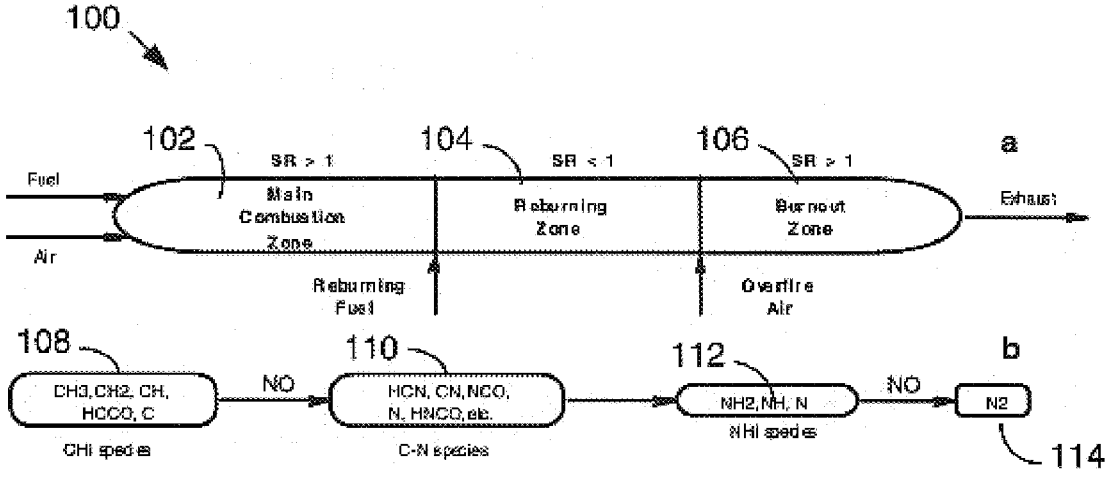
FIG. 1 is a schematic diagram illustrating (a) the reburning process, in corresponding view of (b) the main reaction paths in the reburning zone.
Figure 3:
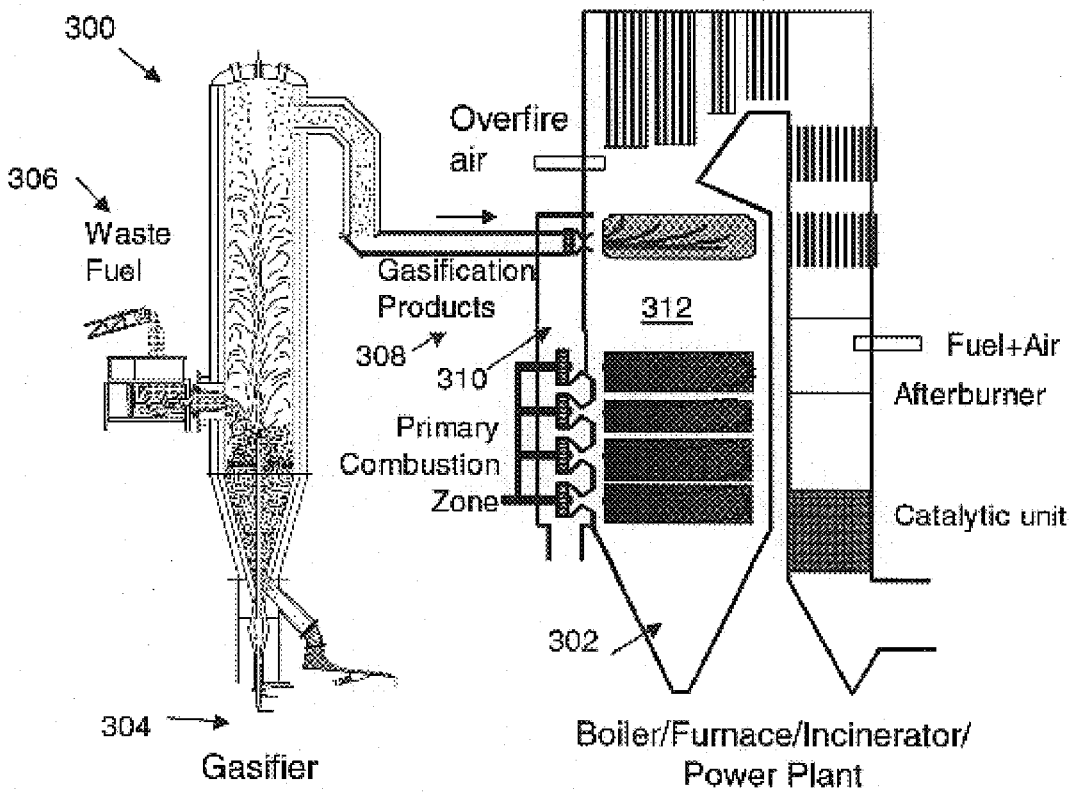
FIG. 3 is a cross-sectional schematic diagram illustrating a waste fuel gasifier in combination with a boiler for realizing the NOx reduction benefits of the present invention.

FIG. 3 illustrates how the present invention can be applied to a coal-fired power plant. The integrated system 300 is an example of integrating a coal-fired boiler 302 with a waste gasifier 304 for achieving reduction of NOx emissions. Although a wall-fired boiler 302 is illustrated, the technology is equally applicable to all firing configurations. Waste fuel 306 is gasified in gasifier 304. Gasification products 308 are conveyed to the furnace 310 and injected into a post combustion zone 312. The amount of the syngas injected into the boiler is controlled to maintain an overall fuel-lean stoichiometry in the upper furnace. Therefore, no additional OFA is required in this configuration. However, OFA could optionally be injected.

The following experimental and modeling examples are given to illustrate the methods and systems of the present invention, and are not intended to limit the scope of the invention.

Figure 4:
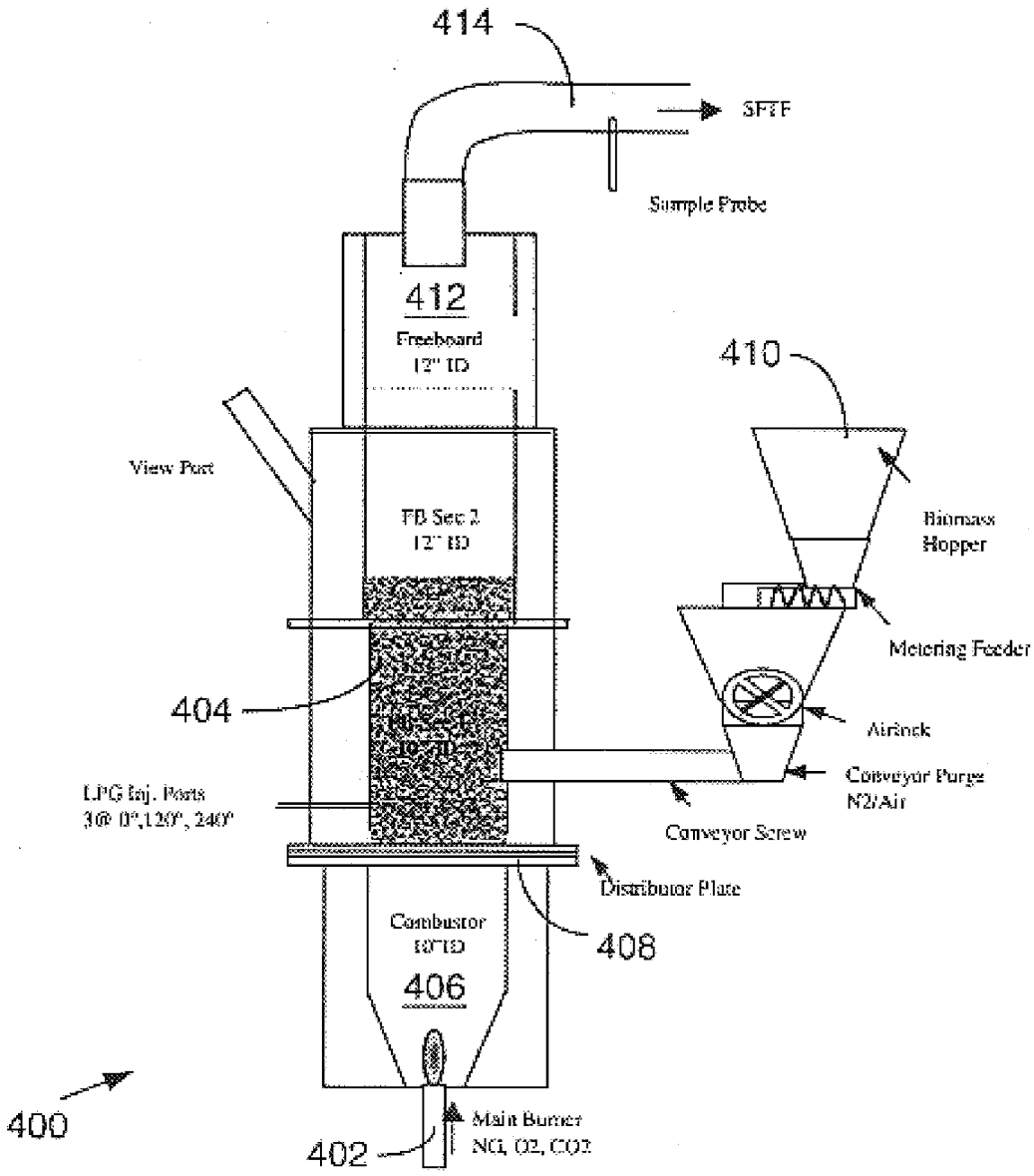
FIG. 4 is a schematic view of a fluidized bed gasifier for use in a system incorporating the present invention.

A Fluidized Bed Gasifier (HFBG) for use in the integrated system of the present invention may be comprised of several sections. For instance, the gasifier 400 as shown in FIG. 4 includes a natural gas burner 402 that supplies auxiliary heat to the fluidized bed 404 during gasification. The firing rate is, for example, about 97,000 Btu/hr. The combustor section 406 may have, for example, an internal diameter of 10" and may be 24" tall. The lower part may be refractory lined, while the upper part may be water-cooled. A stainless steel distributor plate 408 separates the combustor section 406 from the fluidized bed 404.

Waste fuel 410 is injected into the fluidized bed 404, such as previously described and shown in FIG. 3. The gasification products leaving the bed pass through a freeboard section 412. The gasification products are conveyed via a stainless steel duct 414 to be used as a reburning fuel in the SFTF (see FIG. 5).

Liquid Petroleum Gas (LPG) 416, consisting mostly of propane, can be used as an auxiliary fuel and may be injected into the bed to increase the temperature prior to injecting waste fuel 410. The LPG increased bed temperatures from about 1100° F. to 1550° F.

Figure 5:
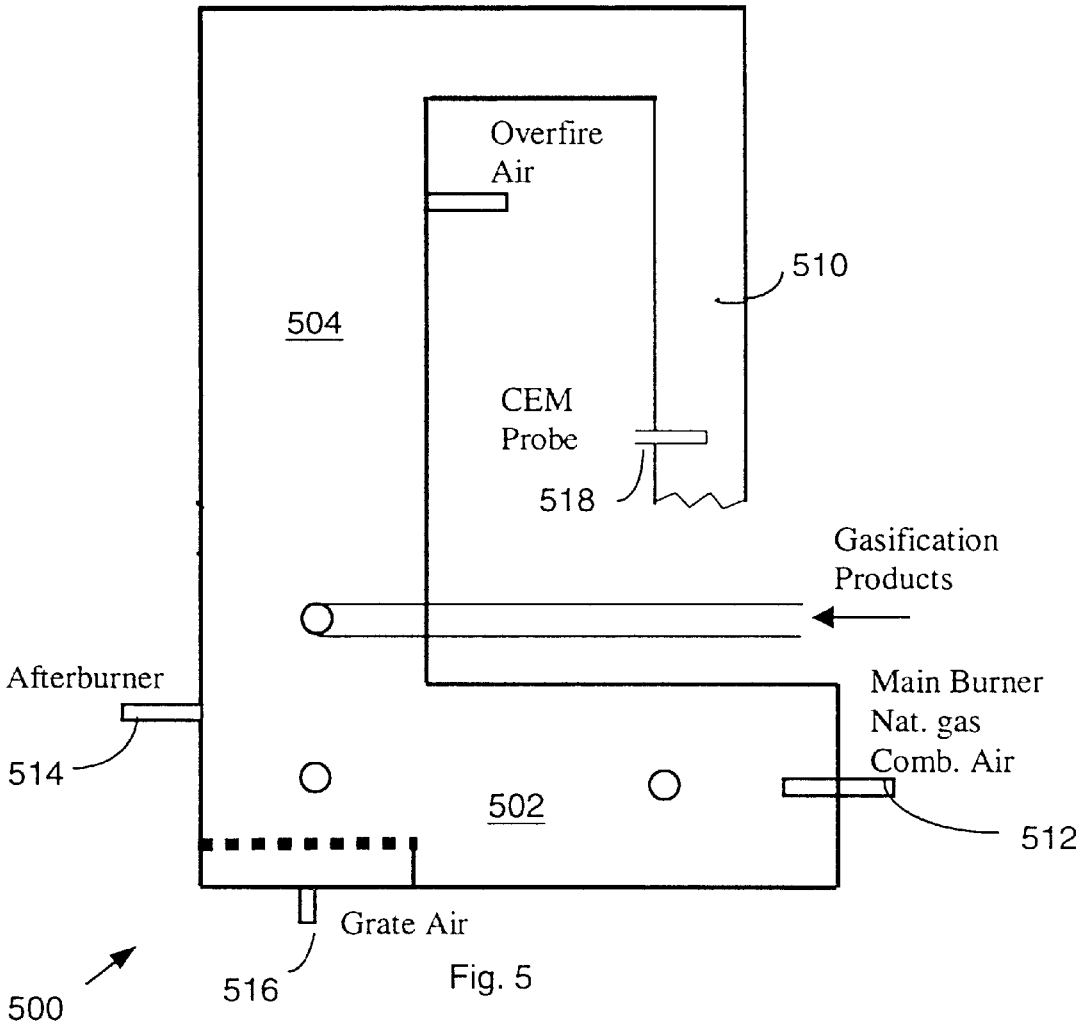
FIG. 5 is a schematic view of a solid fuels test facility for use with a continuous emissions monitoring system in determining the efficacy of and in setting operating conditions for the present invention.

As shown in FIG. 5, an exemplary Solid Fuels Test Facility (SFTF) 500 is comprised of a horizontal barrel section 502, a vertical controlled temperature tower 504, and an exhaust stack 510. The conditions in the SFTF may be, in one instance, set to simulate a biomass-fires stoker boiler.

In one particular arrangement, for example, the horizontal barrel section may have an 18" inner diameter and be about 9 ft long. The main gas burner 512 for the furnace is located in this section. The control temperature tower also has an 18" ID and is about 15 ft tall.

During testing of the arrangement of FIG. 5, the main burner 512 was at 375,000 Btu/hr and the afterburner 514 was at 125,000 Btu/hr. The natural gas and combustion air flow rates for both the main burner and the afterburner as well as the grate air 516 were controlled by flow meters, such as those manufactured by Waukee. Dwyer rotameters, for example, were used to monitor the flow of the OFA, the syngas combustion air, and the waste fuel transport air.

The SFTF exit Continuous Emissions Monitoring system (CEM) consists of a water-cooled sample probe 518, a chiller for removing moisture, a particulate filter, a sample pump, and the following exemplary analyzers: a Servomex Paramagnetic O2 Analyzer (0–100% O2); a Thermo Environmental gas filter correlation IR CO Analyzer (0–2,500 ppm); and a Thermo Environmental Chemiluminescent NO/NOx Analyzer (0–10,000 ppm).

The following description discusses test fuels and composition of gasification products. Five waste fuels were selected for testing: 1) almond shells; 2) walnut tree prunings (Wood "P"); 3) whole tree wood chips (Wood "W"); 4) non-recyclable waste paper; and 5) rice straw (fresh). These fuels generally have characteristics that make direct combustion in biomass boilers not feasible. Some of these properties are characterized by, (a) low heating value, (b) high ash content, (c) high chlorine and/or metal content, and (d) inhomogeneous composition. Tables 1 and 2 show ultimate and ash analysis of waste fuels.

TABLE 1

Ultimate analysis of waste fuels.

| | Rice Straw | Almond Shells | Walnut Tree Prunings (Wood "P") | Whole Tree Wood Chips (Wood "W") | Non Recyclable Waste Paper |
|---|---|---|---|---|---|
| Carbon | 38.50 | 36.27 | 48.20 | 51.15 | 49.11 |
| Hydrogen | 3.56 | 3.94 | 4.41 | 3.40 | 5.08 |
| Nitrogen | 0.55 | 0.79 | 0.59 | 0.35 | 0.14 |
| Sulfur | 0.06 | 0.05 | 0.03 | 0.05 | 0.06 |
| Ash | 21.03 | 26.57 | 2.43 | 2.68 | 1.05 |
| Oxygen | 36.30 | 32.38 | 44.34 | 42.37 | 44.56 |
| Chlorine | 0.58 | 0.03 | <0.01 | <0.01 | 0.03 |

Figure 6:
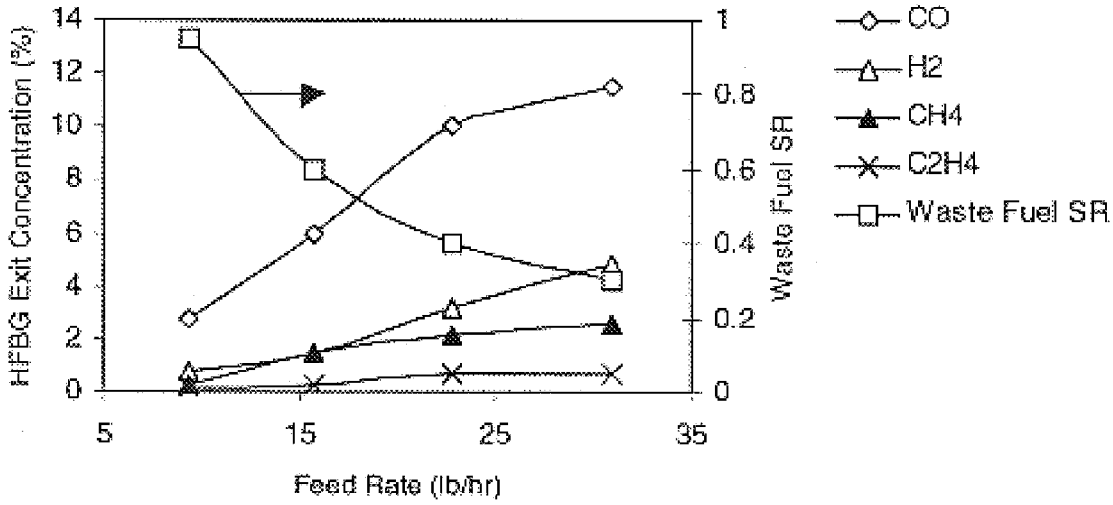
FIG. 6 is a graph illustrating the composition of combustible gases as a function of waste fuel feed rate for almond shell gasification products from a HFBG.

During the testing, waste fuels were gasified in the fluidized bed. During a given test the feed rate of the waste fuel was varied to provide syngas of different heating values and compositions. The primary constituents of the syngas were inert species such as CO2 and N2, which together made up 75–90% of the exit gas. FIG. 6 shows the composition of combustible gases as a function of waste fuel feed rate for almond shells. Note that smaller amounts of heavier hydrocarbons that may be present in gas are not shown here.

TABLE 2

Ash analysis of waste fuels.

| | Rice Straw | Almond Shell | Wood "P" | Wood "W" | Non-Recyclable Paper |
|---|---|---|---|---|---|
| $SiO_2$ | 76.36 | 64.32 | 5.80 | 33.77 | 25.30 |
| $Al_2O_3$ | 0.99 | 12.70 | 2.25 | 7.69 | 23.11 |
| $TiO_2$ | 0.05 | 0.45 | 0.09 | 0.34 | 2.07 |
| $Fe_2O_3$ | 0.31 | 4.32 | 1.23 | 1.25 | 1.37 |
| CaO | 2.17 | 4.20 | 43.90 | 29.00 | 19.50 |
| MgO | 1.71 | 2.10 | 8.08 | 3.54 | 4.56 |
| $Na_2O$ | 0.30 | 1.87 | 0.31 | 1.21 | 6.31 |
| $K_2O$ | 11.90 | 8.54 | 10.60 | 9.01 | 4.44 |
| $P_2O_5$ | 1.55 | 0.72 | 2.32 | 1.83 | 5.75 |
| $SO_3$ | 0.67 | 0.22 | 0.56 | 0.43 | 2.73 |
| Cl | 2.39 | 0.08 | 0.15 | 0.19 | 0.25 |

TABLE 2-continued

Ash analysis of waste fuels.

| | Rice Straw | Almond Shell | Wood "P" | Wood "W" | Non-Recyclable Paper |
|---|---|---|---|---|---|
| $CO_2$ | 0.22 | 0.48 | 23.68 | 3.36 | 1.52 |
| Undetermined | 1.38 | 0.00 | 1.03 | 8.38 | 3.09 |
| Total: | 100.00 | 100.00 | 100.00 | 100.00 | 100.00 |

The stoichiometric ratio (SR) in the bed, as shown on the secondary y-axis, varied from 0.96 to 0.29 and decreased as the almond shell feed rate increased. As more waste fuel was added to the fluidized bed, the levels of CO, H2 and hydrocarbons increased. At the highest feed rate, the syngas consisted of over 11% carbon monoxide, 5% hydrogen, 3% methane, and about 1% ethylene. The gas composition shown corresponded to a dry, particulate free, sample that is collected at the exit of the gasifier.

Figure 7:
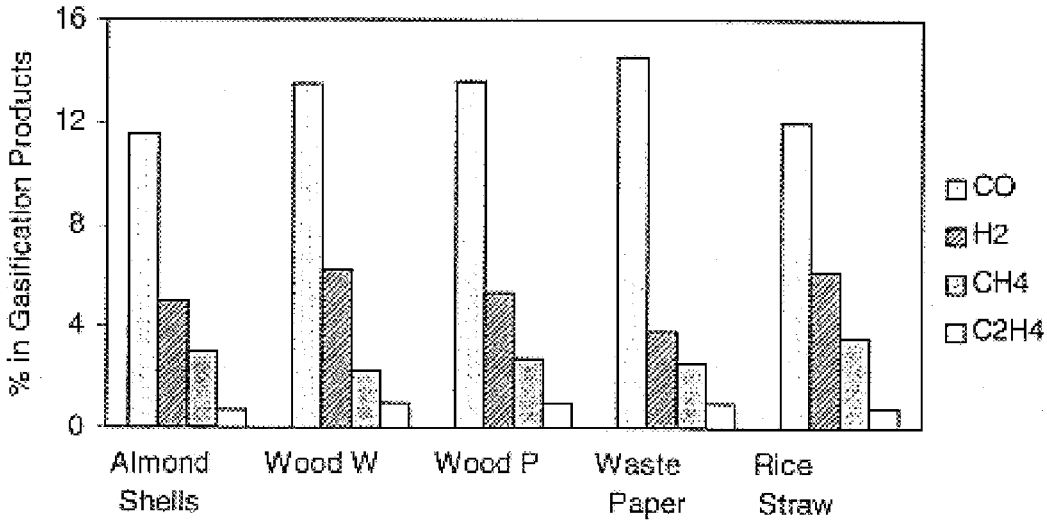
FIG. 7 is a bar graph comparing synthesis gas composition of various waste fuels at a stoichiometric ratio of 0.3.

FIG. 7 compares compositions of main combustible components of gasification gas products from different waste fuels at SR of 0.3, which corresponds to about 20% reburning heat input to the SFTF. The fluidized bed temperature for these tests varied between 1330° F. and 1430° F. The relative levels of CO, H2 and hydrocarbons were a function of stoichiometric ratio, bed temperature and fuel composition. Fuels with higher carbon content gave higher CO emissions. Waste paper had the highest concentration of CO and rice straw had the highest concentration of hydrocarbons.

A process model was developed to describe NOx reduction in the integrated gasification-reburning process. Process modeling helps to understand and predict the effect of system components and conditions on NOx control. In modeling, a set of homogeneous reactions representing the interaction of reactive species was assembled. Each reaction was assigned an appropriate rate constant and heat release or heat loss parameters. Numerical solution of differential equations for time-dependent concentrations of the reagents made it possible to predict the concentration-time curves for all reacting species under selected process conditions. Using the modeling revealed the process conditions required for significant improvements in NOx removal.

Natural gas reburning chemistry-mixing model (RCMM) was used to describe reburning by waste fuel gasification products. The following describes the modeling approach and presents modeling results.

The RCMM includes a combination of a detailed kinetic mechanism with a simplified representation of mixing and utilizes well-stirred and plug-flow reactors to describe processes that occur in the boiler. This approach was successfully used to describe natural gas basic and Advanced Reburning.

The characteristic feature of RCMM is utilization of the integrated approach to describe the reburning process. This approach includes: 1) evaluation of mixing characteristics of the combustion facility under investigation using model of single jet in crossflow; 2) utilization of plug flow reactors to describe processes that occur in the boiler; 3) the distributed addition of reagents; and 4) the inverse mixing approach. The mixing can be described as a secondary stream distributed along the primary stream in a continuous fashion over a certain period of time. It is assumed that composition of products, except for NOx, exiting the primary combustion zone corresponds to equilibrium conditions at the experimental values of temperature. The kinetic mechanism used in RCMM to describe natural gas reburning included 447 reactions of 65 C—H—O—N gas phase species. Since main combustion components of waste fuel gasification products (CH4, H2 and CO) were included in the RCMM mechanism, it gave confidence that RCMM could be applied to describe reburning by fuel gasification products. Reactions of C3 species from GRI-Mech 3.0 kinetic mechanism were added to the natural gas reburning mechanism to enable modeling of LPG reburning.

The chemical kinetic code ODF, for "One Dimensional Flame" was employed to model experimental data. ODF treats a system as a series of one-dimensional reactors. Each reactor may be perfectly mixed (well-stirred) or unmixed (plug-flow). Each ODF reactor may be assigned a variety of thermodynamic characteristics, including adiabatic, isothermal, or specified profiles of temperature or heat flux, and/or pressure. Process streams may be added over any interval of the plug flow reactor, with arbitrary mixing profiles along the reactor length. The flexibility in model setup allows for many different chemical processes to be simulated under a wide variety of mixing conditions.

The adopted approach was similar to that used to describe natural gas reburning. The reburning process was treated as a series of four plug-flow reactors. Each reactor described one of the physical and chemical processes occurring in a boiler, for example: addition of the reburning fuel; NOx reduction as a result of reaction with the reburning fuel; addition of overfire air; and oxidation of partially oxidized products.

The mixing was described by adding flue gas to the injecting stream (inverse mixing) over mixing time. For example, mixing in the reburning zone was described by adding flue gas to the flow of gasification products; mixing of OFA was described by adding flue gas to the OFA.

The mixing time in the reburning zone was an adjustable parameter. For the reburning fuel and OFA jets, the mixing time was adopted to be 120 ms, the same as was estimated for experimental conditions. This is also the same value that was estimated for similar conditions using a model of a single jet in cross flow for natural gas reburning. Modeling showed that the value of the mixing time had a relatively small effect on the efficiency of NOx reduction. For example, a 100% decrease in mixing time resulted in about 30% improvement in the reburning efficiency.

As in experiments, flue gas compositions in the main and OFA zones corresponded to SR1=1.1 and SR3=1.25, respectively. Initial NOx (NOi) was 300 ppm.

Next we consider the composition of gasification products in modeling. The presence of fuel-N and sodium in gasification gas has to be taken into account to explain experimental observations.

The concentration of N in waste fuels (Table 1) is less than 1% and is less than is usually found in coals (1%–2%). However, this amount of fuel-N can contribute to NOx production and reduction. Because of the large volatile content of waste fuels, it can be expected that most fuel-N is released into the gas phase. When injected in the reburning zone, and depending on conditions in this zone, N-containing species can be partially reduced to molecular nitrogen N2, partially oxidized by excess air coming from the main combustion zone to form NOx, or can react with NO from flue gas and reduced to N2.

Ash analysis (Table 2) showed that sodium content in some waste fuels was significant. Adding sodium compounds to the reburning and overfire (in presence of N-agent) zones can increase NOx reduction.

Reactions of Na with components of flue gas have been studied in connection with reduction of NO and N2O emissions in SNCR and reburning processes. The chemistry of NaOH decomposition and reactions with C—H—O—N species at high temperatures were incorporated into the kinetic model by adding reactions of Na species to the reaction mechanism used to describe waste fuel reburning.

Concentrations of N- and Na-containing species in gasification products were estimated. It was assumed that as waste fuel was gasified, 80% of the fuel-N was released, comprising approximately 50% as NH3 and 50% as N2. The remaining 20% was assumed to be bound in the char residue. It was also assumed that NH3 concentration in gasification products increased with the increase in the reburning fuel heat input. This assumption was based on the following consideration. In tests, an increase in the reburning fuel heat input was achieved by increasing the amount of waste fuel in the gasifier while supply of air was constant. This produced gasification products with larger concentrations of hydrocarbons, H2 and CO. It is reasonable to assume that concentrations of N-containing species in gasification products also increased with an increase in waste load in the gasifier. Estimations of NH3 concentration in gasification products made using this approach agreed reasonably well with experimental measurements. For example, concentration of NH3 in gasification products of almond shells at 7.3% reburning heat input was estimated using this approach to be 1,100 ppm. This estimate qualitatively agrees with value 750 ppm measured using the Drager tube. It should be noted that the Drager tube measurements have low accuracy and should be used only for the order of magnitude estimate of NH3 concentration.

The concentration of sodium containing species (represented in modeling as NaOH) in reburning fuel was estimated using the following approach. First, equilibrium concentrations of Na-containing species in the gas phase in the gasifier were calculated using NASA equilibrium code/standard CET93. These calculations were done for the temperature in the gasifier at 1500° F. for each waste fuel using data on Na content from Table 2. Equilibrium calculations predicted that most stable Na-containing species in the gas phase were atomic Na and NaOH(g). Second, concentrations of Na-containing species in the reburning fuel were determined using calculated equilibrium Na and NaOH concentrations in gasification products and volumes of streams of gasification products and dilution streams of N2 (carrier for the reburning fuel) and CO2 (fluidizing media in the gasifier).

The following are examples of determining the efficacy of NOx reduction in the integrated direct combustion and gasification system of the present invention.

Figure 8:
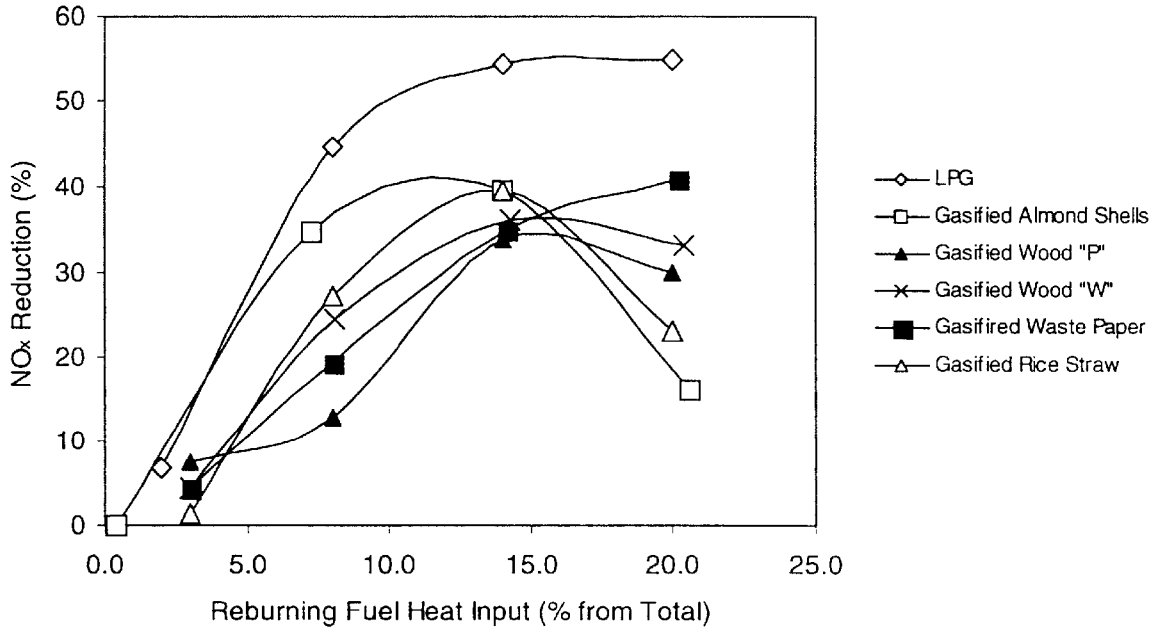
FIG. 8 is a graph comparing reburning performance of gasified waste fuels at NOi=300 ppm.

In a first example, tests were conducted to evaluate efficiency of gasification products as a reburning fuel. The SFTF was fired on natural gas at a baseline firing-rate of 500,000 Btu/hr. The gasification products were injected as reburning fuel. Temperature of flue gas at the location of reburning fuel injection was 2150° F. The OFA was injected at flue gas temperature of 1850° F. FIG. 8 shows NO reduction as a function of reburning heat input for various waste fuels. For comparison the reburn performance of LPG is also shown. Presented data correspond to initial NO levels of 300 ppm (at 0% O2). Initial NO level was controlled by ammonia injection in the main burner.

FIG. 8 shows that the reburning performance of gasified waste fuel increased with an increase in reburning fuel heat input. However, with the exception of waste paper, the performance dipped at 20% reburning. The waste fuels contain varying amounts of nitrogen (see Table 1) and sodium (see Table 2). The fuel nitrogen can form nitrogenous species such as ammonia and hydrogen cyanide in the gasification products. Measurements of NH3 concentration in gasification products confirmed that a significant fraction of fuel-N in waste fuel was converted to NH3 in the gasifier. Measurements using Drager tube revealed that at 7.3% of the reburning fuel heat input, NH3 concentrations in almond shells and sewage sludge gasification products were 750 ppm and 850 ppm, respectively. NH3 can form NO in the presence of excess oxygen supplied by the OFA. Because a higher amount of reburning fuel corresponded to a higher biomass feed rate, the impact of fuel nitrogen on reburning performance was enhanced at higher reburning rates. The greatest dip in performance was observed for the almond shells and rice straw that had 0.79% and 0.55% fuel nitrogen, respectively. No performance dip was observed for the waste paper, which has only 0.14% fuel nitrogen.

This example demonstrates that for fuels with relatively high fuel-N content, there is a maximum in reburning NOx control efficiency corresponding to approximately 7–15% of reburning fuel heat input.

Figure 9:
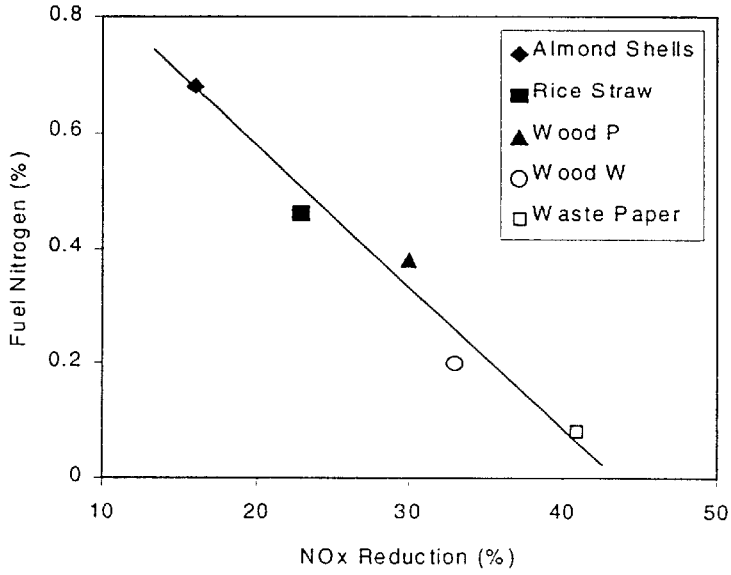
FIG. 9 is a graph illustrating the exemplary correlation for NOx reduction and fuel-N at 20% reburning heat input.

In a second example, tests were conducted under the same conditions as those in the first example. FIG. 9 shows reburning performance at 20% reburning fuel heat input for waste fuels as a function of fuel nitrogen content. FIG. 9 demonstrates linear correlation between fuel-N waste fuel content and NO reduction at large heat input of the reburning fuel and confirms that fuel-N plays an important role in NOx reduction/formation at large levels of heat input of the reburning fuel.

This example demonstrates that the presence of NH3 in gasification products results in a decrease in efficiency of NOx reduction at large heat input of the reburning fuel because NH3 was oxidized to form NOx.

Figure 10:
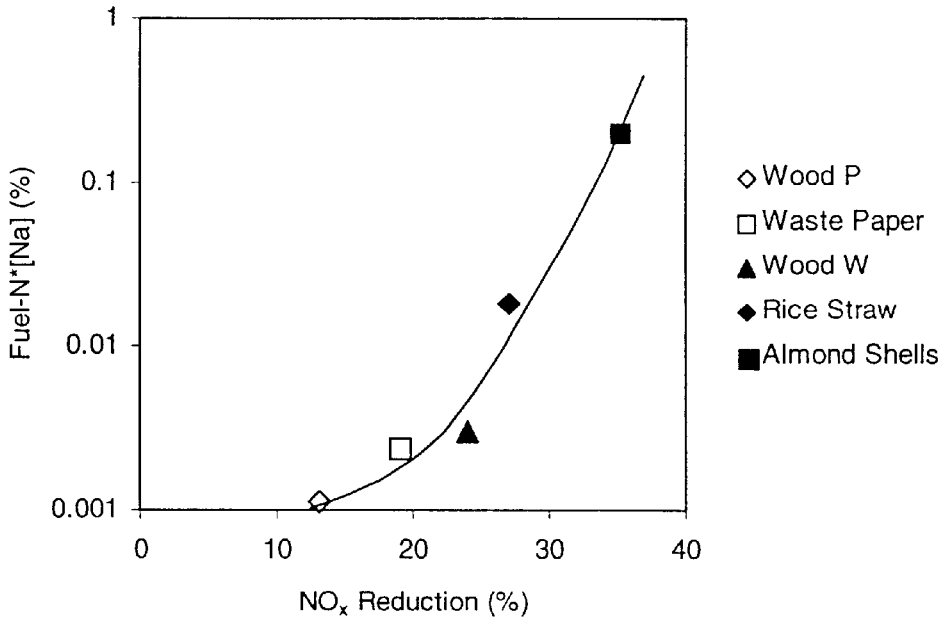
FIG. 10 is a graph illustrating the exemplary correlation between Fuel-N and sodium content of waste fuel and NOx reduction at 8% reburning heat input.

In a third example, tests were conducted under the same conditions as those in the first example. FIG. 8 shows that NOx reduction at small heat input of the reburning fuel (approximately 6%–15%) is different for different waste fuels. These differences are due to differences in compositions of gasification products of waste fuels. FIG. 10 shows correlation between NOx reduction and concentrations of fuel-N and sodium in waste fuel at 8% reburning fuel heat input.

This example demonstrates that both fuel-N and sodium content of waste fuel determine the efficiency of NOx reduction by gasification products at relatively small heat input of the reburning fuel. The larger fuel-N and sodium content of waste fuel results in a deeper NOx reduction.

In a fourth example, tests using the pilot scale facilities of FIG. 2 were conducted to determine the effect of flue gas temperature at the location of the reburning fuel injection on NOx reduction. The efficiency of NO reduction in reburning increases with an increase in flue gas temperature at which reburning fuel is injected. This is because at higher temperatures reburning fuel is oxidized faster, resulting in faster generation of active species involved in NO reduction.

Figure 11:
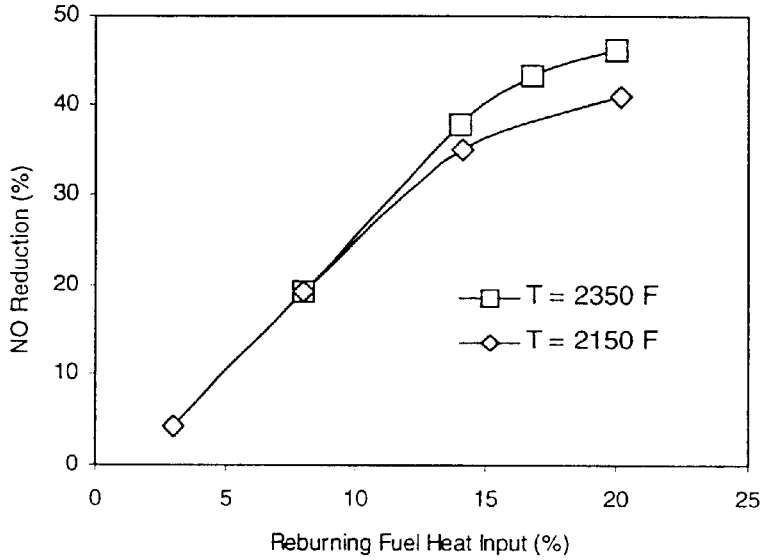
FIG. 11 is a graph comparing the NOx reduction efficacy in the example of waste paper reburning at 2350° F. and 2150° F.

Tests conducted with gasification products of waste paper confirmed this expectation. FIG. 11 shows that the efficiency of NO reduction increased by about 5 percent at 20% reburning fuel heat input as temperature increased from 2150° F. to 2350° F.

This example demonstrates that for fuels with relatively low fuel-N content, the efficiency of NO reduction in reburning increases with an increase in flue gas temperature at which reburning fuel is injected.

Figure 12:
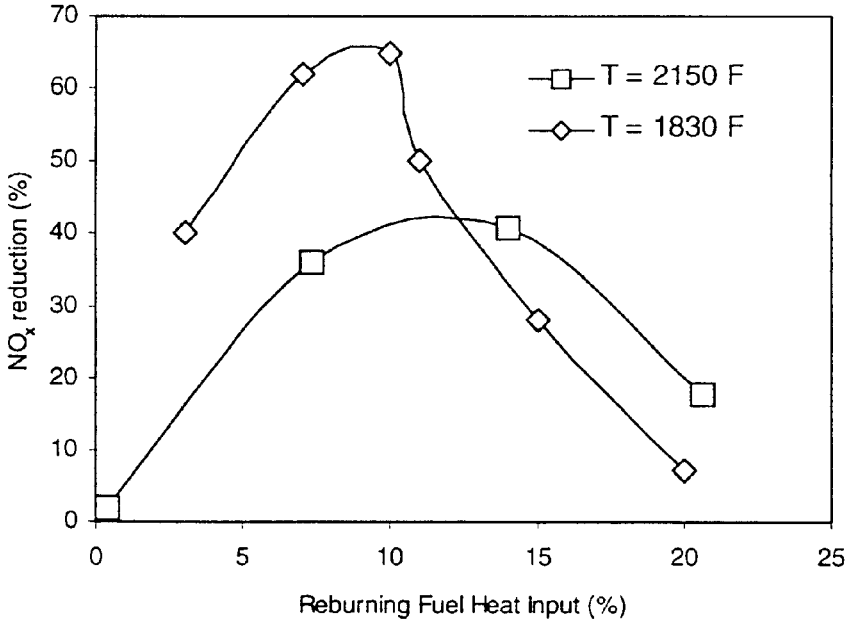
FIG. 12 is a graph comparing the NOx reduction efficacy for examples of almond shells reburning at 2150° F. and 1830° F.
Figure 13:
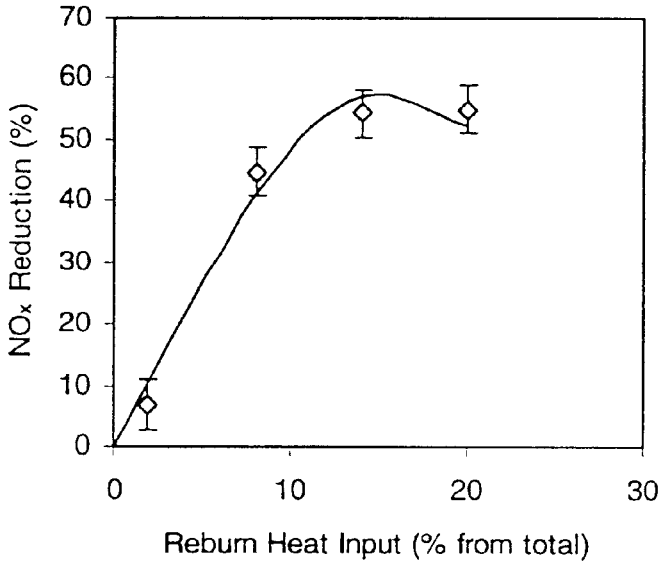
FIG. 13 is a graph comparing the NOx reduction efficacy of modeling predictions vs. experimental data for LPG reburning.
Figure 14:
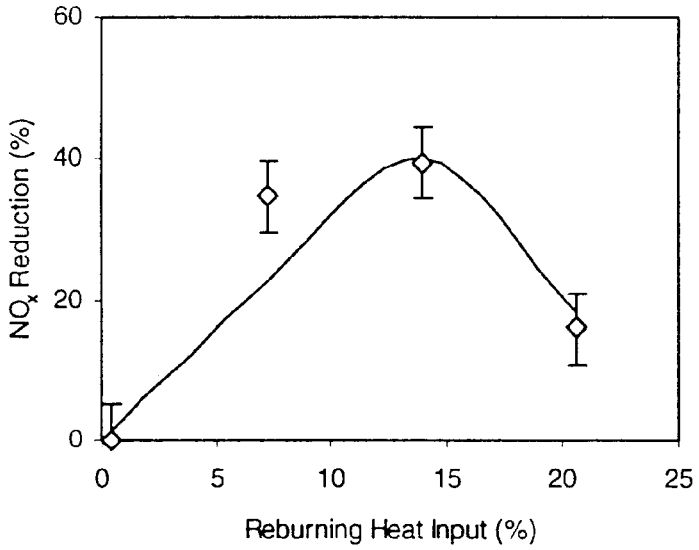
FIG. 14 is a graph comparing the NOx reduction efficacy of modeling predictions vs. experimental data for the example of reburning with almond shells gasification products.
Figure 15:
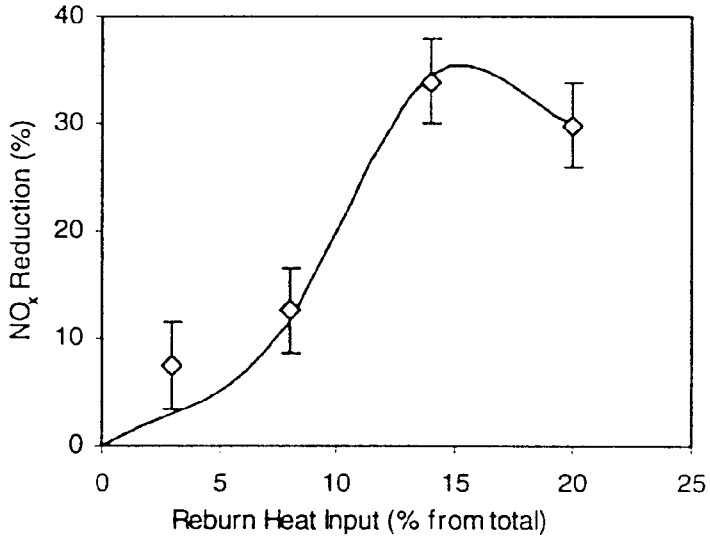
FIG. 15 is a graph comparing the NOx reduction efficacy of modeling predictions vs. experimental data for the example of wood P gasification products.
Figure 16:
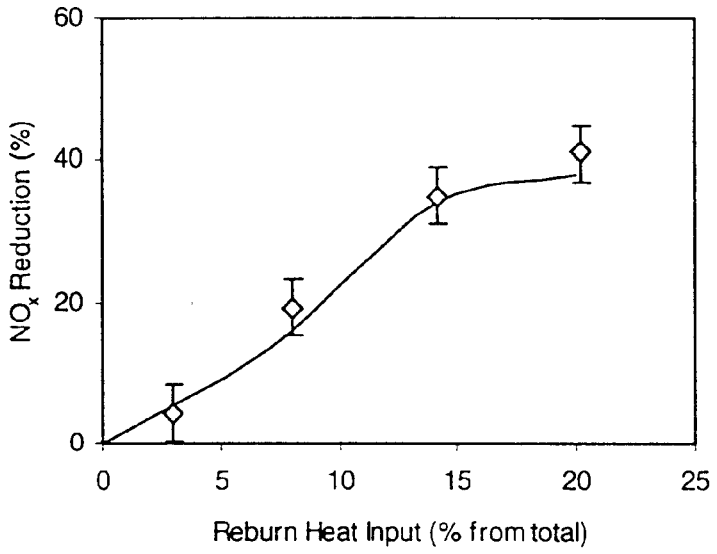
FIG. 16 is a graph comparing the NOx reduction efficacy of modeling predictions vs. experimental data for the example of reburning with waste paper gasification products.

In a fifth example, tests in the pilot scale facilities of FIG. 2 were conducted to determine the effect of flue gas temperature at the location of the reburning fuel injection and reburning fuel heat input on NOx reduction. One unexpected finding of the invention was that performance of gasification products as a reburning fuel of some waste fuels improved with a decrease in temperature. FIG. 12 compares reburning performance of almond shells gasification products at 1830° F. and 2150° F. FIG. 12 shows that maximum NO reduction increased from 40% to 65% as reburning fuel injection temperature decreased from 2150° F. to 1830° F. Optimum NO reduction at 1830° F. was achieved at 7–10% reburning fuel heat input while at 2150° F. optimum was achieved at 10–15% reburning fuel heat input.

This example demonstrates that NOx control achieved with gasification products as reburning fuel can be significantly higher at lower reburning fuel injection temperatures. A high level of NOx control can be achieved at a low reburning fuel heat input of 7–10%.

In a sixth example, fuel nitrogen and sodium impacts on reburning performance were evaluated through the above-described modeling study. FIGS. 13–16 present comparison of modeling predictions (curves) and experimental data (points). As in experiments, reburning fuel and OFA were injected in the model at flue gas temperatures of 2150° F. and 1850° F., respectively. Modeling predicted that performance of LPG improved as the amount of reburning fuel increased. The same behavior was predicted for waste paper for which fuel-N content (Table 1) was very low. The model predicts that the efficiency of NOx reduction for almond shells and Wood P, on the other hand, decreases when the amount of the reburning fuel is over 15% by heat input. The model explains this effect as oxidation of the NH3 present in the reburning fuel to NO at 2150° F.

Figure 17:
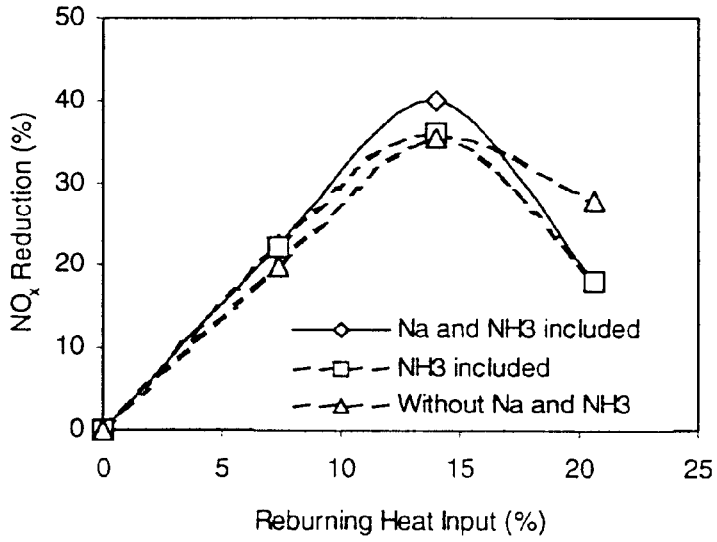
FIG. 17 is a graph comparing the predicted effects of Na and NH3 on NOx reduction for the example of almond shells reburning at 2150° F.

Predicted effects of Na and NH3 on NOx reduction in almond shells reburning are demonstrated in FIG. 17. The efficiency of NOx reduction without Na and NH3 was relatively lesser at 15% reburning heat input and greater at 20% reburning heat input. At 20% reburning heat input, the amount of NH3 in reburning fuel was too large, which led to the undesired result of some NH3 being oxidized to NOx.

This example demonstrates that the model correctly predicts NOx reduction for reburning with gasification products with different gas composition, including the concentration of NH3 and sodium compounds in gasification products. The model also correctly predicts NOx reduction at reburning heat inputs in the range of 0–20%.

In a seventh example, close agreement of modeling predictions and experimental data for different gasified fuels, as demonstrated in the sixth example, provides confidence that the model correctly predicts key benefits of the inventive process. In this example, the model is used to determine the effect of temperature on reburning with syngas containing a high amount of fuel-N and Na.

Figure 18:
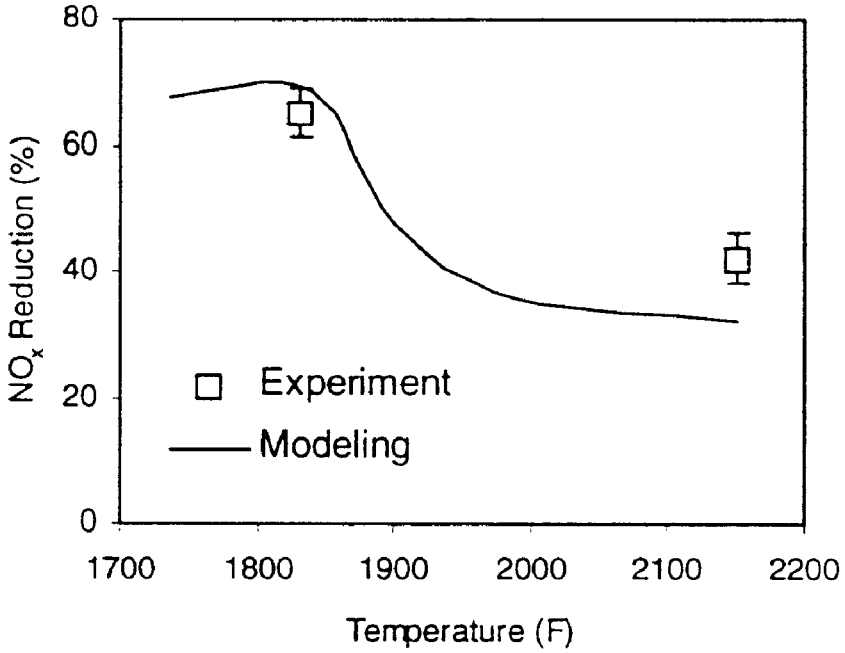
FIG. 18 is a graph illustrating the predicted temperature dependence of the efficiency of NOx reduction in reburning with almond shells gasification products.

FIG. 18 shows predicted efficiency of NOx reduction (curve) in reburning with almond shells gasification products as a function of flue gas temperature at which reburning fuel was injected at 10% reburning fuel heat input. Experimental data are also shown (points). Modeling predicted that efficiency of NOx reduction could be increased up to 70% by lowering flue gas temperature at which reburning fuel is injected. The efficiency of NOx reduction increased with a decrease in temperature because optimum temperatures for NOx reduction by NH3 are in the range of 1800° F.–2000° F. The model predicts that an optimum in NOx reduction occurs even at lower temperatures in the presence of CO and H2 syngas components. Since concentrations of CO and H2 in gasification products of all tested waste fuels are high (see FIG. 7), the efficiency of NOx reduction in almond shells reburning reaches maximum at about 1750° F.–1800° F.

This example demonstrates that the efficiency of NOx control with gasification products increases at lower temperatures and can be as high as approximately 70% at only 10% of reburning fuel by heat input. The optimum temperature of NOx control is largely defined by the composition of gasification products (CO, H2, hydrocarbons, N- and alkali-containing compounds), composition of the flue gas at the point of reburning fuel injection, and the temperature of flue gas at the point of reburning fuel injection.

As observed in examining the results of the various examples and tests, the present invention provides a method of decreasing the concentration of nitrogen oxides in combustion systems and utilization of low grade solid fuels. One example of a process for achieving the benefits of the present invention includes the following described steps. A first step of causing combustion of the main fuel in a combustion system resulting in generating a combustion flue gas in a post combustion zone. The combustion flue gas includes nitrogen oxides. The next step involves the gasification of solid fuels in a gasifier so as to generate gaseous product containing solid particles. The gaseous product includes at least one or more of the group consisting of carbon monoxide, hydrogen, hydrocarbons, steam, carbon dioxide, ammonia and other reduced N-containing species, and small amounts of alkali-containing compounds. Next, the gaseous products are injected into the post combustion zone of the combustion system to create a reaction zone in which nitrogen oxides are reduced to molecular nitrogen.

In addition, this exemplary embodiment of the present invention may involve one or more of the following aspects. The main fuel may be selected from coal, biomass, waste products, or combinations of thereof. The gasified solid fuel may be selected from biomass, waste products, coal or combination of thereof. The concentrations of carbon monoxide, hydrogen, and hydrocarbons in gasification products may be in the range of 0.1%–30% each. In one preferred embodiment, the concentrations of hydrocarbons in gasification products are in the range of 0.5%–10%. The concentrations of ammonia and other reduced N-containing species in gasification products may be in the range of 50–10,000 ppm. The molar ratio of ammonia and other reduced N-containing species in gasification products injected in the combustor to the NO in the post combustion zone may be in the range of 0.2–2.0. In one preferred embodiment, the molar ratio of ammonia and other reduced N-containing species in gasification products injected in the combustor to the NO in the post combustion zone may be in the range of 0.8–1.5. The concentrations of alkali-containing species in the gaseous product may be in the range of 1–300 ppm. In one embodiment, the preferred concentrations of alkali-containing species in the gaseous product may be in the range of 20–100 ppm. The temperatures of flue gas at the location of the gaseous product injection may be in the range of 1600° F.–2300° F. The amount of the gaseous products injected in the post combustion zone may be in the range of 5–25% of the total fuel by heat input. In one embodiment, the preferred amount of the gaseous products injected in the post combustion zone may be in the range of 7–12% of the total fuel by heat input. The overfire air may be injected downstream of the gaseous products injection point to oxidize remaining combustible products.

Further, overfire air can be injected or an afterburner may be installed downstream of the gaseous products injection point to oxidize remaining combustible products. A catalytic unit may be installed downstream of the gaseous products injection point to oxidize remaining combustible products. Solid particles, such as char, soot, and fly ash, may be separated from the gaseous product before injection in the post combustion zone. In addition, such solid particles may be separated from the gaseous product before injection in the post combustion zone and directed to the main combustion zone.

While the invention has been described with reference to particular embodiments and examples, those skilled in the art will appreciate that various modifications may be made thereto without significantly departing from the spirit and scope of the invention.

What is claimed is:

1. A method of decreasing emissions of nitrogen oxides (NOx) in combustion systems in combination with gasification of at least one solid fuel, the method comprising the steps of:

a. causing the combustion of a main fuel in a combustion system, thereby resulting in the generation of a combustion flue gas in a post combustion zone, the combustion flue gas comprising nitrogen oxides;

b. gasifying at least one solid fuel in a gasifier causing the generation of a gaseous product containing solid particles, the gaseous product comprising small amounts of alkali-containing compounds, ammonia and other reduced N-containing species, and one or more of the group consisting of carbon monoxide, hydrogen, water, and carbon dioxide; and c. injecting the gaseous product into the post combustion zone of the combustion system to create a reaction zone in which nitrogen oxides are reduced to molecular nitrogen under conditions designed to promote reaction of NO with ammonia, other reduced N-containing species, and alkali-containing compounds in the presence of one or more of the group comprising syngas components, CO, H2, and hydrocarbons, said conditions including at least a temperature of the combustion flue gas at an injection point in the post combustion zone being in the range of 1600–2060° F.

2. The method of claim 1, wherein the gasified solid fuel comprises one or more of the group consisting of coal, biomass, and waste products.

3. The method of claim 2, wherein the gasified solid full is comprised of one or more of the group consisting of straw, rice straw, tree prunings, tree tarts, wood chips, saw dust, paper products, and sewage sludge.

4. The method of claim 1, wherein concentrations of carbon monoxide, hydrogen, and hydrocarbons in gasification products are in the range of 0.1%–30% each.

5. The method of claim 1, wherein the concentrations of hydrocarbons in gasification products are in the range of 0.5%–10%.

6. The method of claim 1, wherein concentrations of ammonia and other reduced N-containing species in gasification products are in the range of 50–10,000 ppm.

7. The method of claim 1, wherein the molar ratio of ammonia and other reduced N-containing species in gasification products injected in the combustor to the NOx in the post combustion zone is in the range of 0.1–10.0.

8. The method of claim 1, wherein the molar ratio of ammonia and other reduced N-containing species in gasification products injected in the combustor to the NOx in the post combustion zone is in the range of 0.8–1.5.

9. The method of claim 1, wherein the concentrations of alkali-containing species in the gaseous product are in the range of 1–300 ppm.

10.The method of claim 1, wherein the preferred concentrations of alkali-containing species in the gaseous product are in the range of 20–100 ppm.

11. The method of claim 1, wherein the temperatures of flue gas at the location of the gaseous product injection are in the range of 1600° F.–2000° F.

12. The method of claim 1, wherein the amount of the gaseous products injected in the post combustion zone is in the range of 5–25% of the total fuel by heat input.

13. The method of claim 1, wherein the amount of the gaseous products injected in the post combustion zone is in the range of 7–15% of the total fuel by heat input.

14. The method of claim 1, wherein overfire air is inject downstream of the gaseous products injection point to oxidize remaining combustible products.

15. The method of claim 1, wherein an afterburner is installed downstream of the gaseous products injection point to oxidize remaining combustible products.

16. The method of claim 1, wherein a catalytic unit is installed downstream of the gaseous products injection point to oxidize remaining combustible products.

17. The method of claim 1, wherein solid particles, including one or more of the group consisting of char, soot, and fly ash, are separated from the gaseous product before injection in the post combustion zone.

18. The method of claim 1, wherein solid particles, including one or more of the group consisting of char, soot, and fly ash, are separated from the gaseous product before injection in the post combustion zone and directed to the main combustion zone.

19. The combustion system of claim 18, wherein the molar ratio of ammonia and other reduced N-containing species in gasification products injected in the combustor to the NOx in the post combustion zone is in the range of 0.1–10.0.

20. A combustion system for causing the combustion of fuel, the combustion of fuel resulting in the generation of post-combustion flue gas, including NOx, the combustion system comprising:

a primary combustion zone in which the combustion of a main fuel occurs, the combustion of the main fuel generating flue gas, which exit the combustion zone;

a post-combustion zone for receiving the flue gas; and a gasifier receiving biomass or waste fuel and producing gaseous product at least in part therefrom and delivering the gaseous product into the post-combustion zone for reacting with the flue gas to reduce NOx emissions, the gaseous product comprising small amounts of alkali-containing compounds, ammonia and other reduced N-containing species, and one or more of the group consisting of carbon monoxide, hydrogen water, and carbon dioxide, the gaseous product being introduced into the post combustion zone under conditions designed to promote reaction of NO with ammonia, other reduced N-containing species and alkali-containing compounds in the presence of one or more of the group comprising syngas components, CO, $H_2$, and hydrocarbons said conditions including at least a temperature of the combustion flue gas at an injection point in the post combustion zone being in the range of 1600–2060° F.

21. The combustion system of claim 20, wherein the post-combustion zone is a reburning zone and the gaseous product is a reburning fuel injected in of the reburning zone.

22. The combustion system of claim 21, further comprising an afterburner disposed downstream of the gaseous product injection.

23. The combustion system of claim 20, wherein the efficiency of NOx emission reduction increases with a reduction in the gaseous product temperature.

24. The combustion system of claim 20, wherein the efficiency of NOx emission reduction is inversely related to the gaseous product temperature.

25. The combustion system of claim 20, wherein the gaseous product temperature is between 1600° F. and 2300° F.

26. The combustion system of claim 20, wherein a near-optimal NOx reduction is accomplished with a 5%–15% gaseous product heat input.

27. The combustion system of claim 20, wherein an optimal NOx reduction is accomplished with a 7%–12% gaseous product heat input.

28. The combustion system of claim 20, wherein the was the fuel is one of a solid or a liquid prior to gasification.

29. The combustion system of claim 20, wherein the gasifier is a fluidized bed gasifier.

30. The combustion system of claim 20, further comprising a section in which overfire air is injected downstream of the post-combustion zone to further combust remaining un-combusted species.

31. The combustion system of claim 20, wherein the combustion zone is a part of one of the group consisting of a power plant, boiler, furnace, incinerator, and any combinations thereof.

32. The combustion system of claim 20, further comprising a continuous emissions monitoring system.

33. The combustion system of claim 20, wherein the waste fuel comprises one or more of the group consisting of coal, biomass, and waste products.

34. The combustion system of claim 33, wherein the waste fuel is comprised of one or more of the group consisting of straw, rice straw, tree parts, wood chips, saw dust, paper products, and sewage sludge.

35. The combustion system of claim 20, wherein concentrations of carbon monoxide, hydrogen, and hydrocarbons in gasification products are in the range of 0.1%–30% each.

36. The combustion system of claim 20, wherein concentrations of ammonia and other reduced N-containing species in gasification products are in the range of 50–10,000 ppm.

37. The combustion system of claim 20, wherein the molar ratio of ammonia and other reduced N-containing species in gasification products injected in the combustor to the NOx in the post combustion zone is in the range of 0.8–1.5.

38. The combustion system of claim 20, wherein the concentrations of alkali-containing species in the gaseous product are in the range of 1–300 ppm.

39. The combustion system of claim 20, wherein the preferred concentrations of alkali-containing species in the gaseous product are in the range of 20–100 ppm.

40. The combustion system of claim 20, wherein the temperatures of flue gas at the location of the gaseous product injection are in the range of 1600° F.–2000° F.

41. The combustion system of claim 20, wherein the amount of the gaseous products injected in the post combustion zone is in the range of 5–25% of the total fuel by heat input.

42. The combustion system of claim 20, wherein a catalytic unit is installed downstream of the gaseous products injection point to oxidize remaining combustible products.

43. The combustion system of claim 20, wherein solid particles, including one or more of the group consisting of char, soot, and fly ash, are separated from the gaseous product before injection in the post combustion zone.

44. The combustion system of claim 20, wherein solid particles, including one or more of the group consisting of char, soot, and fly ash, are separated from the gaseous product before injection in the post combustion zone and directed to the main combustion zone.

45. The combustion system of claim 20, wherein no overfire section is included downstream of the combustion zone.

* * * * *